US006505535B1

(12) United States Patent
Kurita et al.

(10) Patent No.: US 6,505,535 B1
(45) Date of Patent: Jan. 14, 2003

(54) METHOD AND APPARATUS FOR MANUFACTURING A PRESS-FORMED OBJECT

(75) Inventors: Mikiya Kurita, Toyoake (JP); Shouichi Takenouchi, Toyota (JP); Kouichi Ohta, Okazaki (JP); Katsumi Nagasaka, Obu (JP); Motofumi Kuzuno, Nagoya (JP); Hiroyuki Dekita, Toyota (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/586,154

(22) Filed: Jun. 2, 2000

(30) Foreign Application Priority Data

Jun. 4, 1999 (JP) ..... 11-158422

(51) Int. Cl.[7] ..... B26D 5/20; B30B 13/00
(52) U.S. Cl. ..... 83/34; 83/220
(58) Field of Search ..... 83/34, 35, 36, 83/219, 220, 256, 681, 684, 685, 686, 687, 688, 689, 690, 691

(56) References Cited

U.S. PATENT DOCUMENTS 1,053,694 A * 2/1913 Anderson ..... 83/220
1,469,757 A * 10/1923 Sibley, II ..... 83/35
3,083,926 A * 4/1963 Herr ..... 83/36
3,854,355 A * 12/1974 Anefall ..... 83/34
4,144,783 A * 3/1979 Yamazaki et al. ..... 83/219
4,602,541 A * 7/1986 Benzinger et al. ..... 83/36
5,744,213 A * 4/1998 Nelson ..... 83/681
5,794,501 A * 8/1998 Sasaki et al. ..... 83/34
6,009,787 A * 1/2000 Hanggi ..... 83/688

FOREIGN PATENT DOCUMENTS

JP A-3-207600 9/1991
JP A-8-10870 1/1996

* cited by examiner

*Primary Examiner*—Allan N. Shoap
*Assistant Examiner*—Stephen Choi
(74) *Attorney, Agent, or Firm*—Harness, Dickey & Pierce, PLC

(57) ABSTRACT

A manufacturing method and a press apparatus improve the productivity of the manufacture of a press-formed object from a sheet blank, such as a nozzle hole plate of a fuel injector. The nozzle hole plate of a fuel injector has a plurality of holes differing, for example, in size and punch direction with respect to the sheet blank. In the case of the manufacture of a nozzle hole plate, a first amount of nozzle holes of equal punch angle and size are formed continuously by a die unit in a bandlike sheet blank workpiece while the workpiece is fed through the die unit one way in its length wise direction. Then, the feed direction is reversed, and the die unit is rotated and a further amount of nozzle holes are formed continuously by the same die unit. As a result, the number of die unit positioning operations involved in forming a quantity of nozzle hole plates is equal only to the number of different nozzle holes formed in each nozzle hole plate. The greater the number of nozzle hole plates manufactured from a single roll of bandlike sheet, the more manufacturing labor is saved, and the greater productivity is improved.

5 Claims, 9 Drawing Sheets

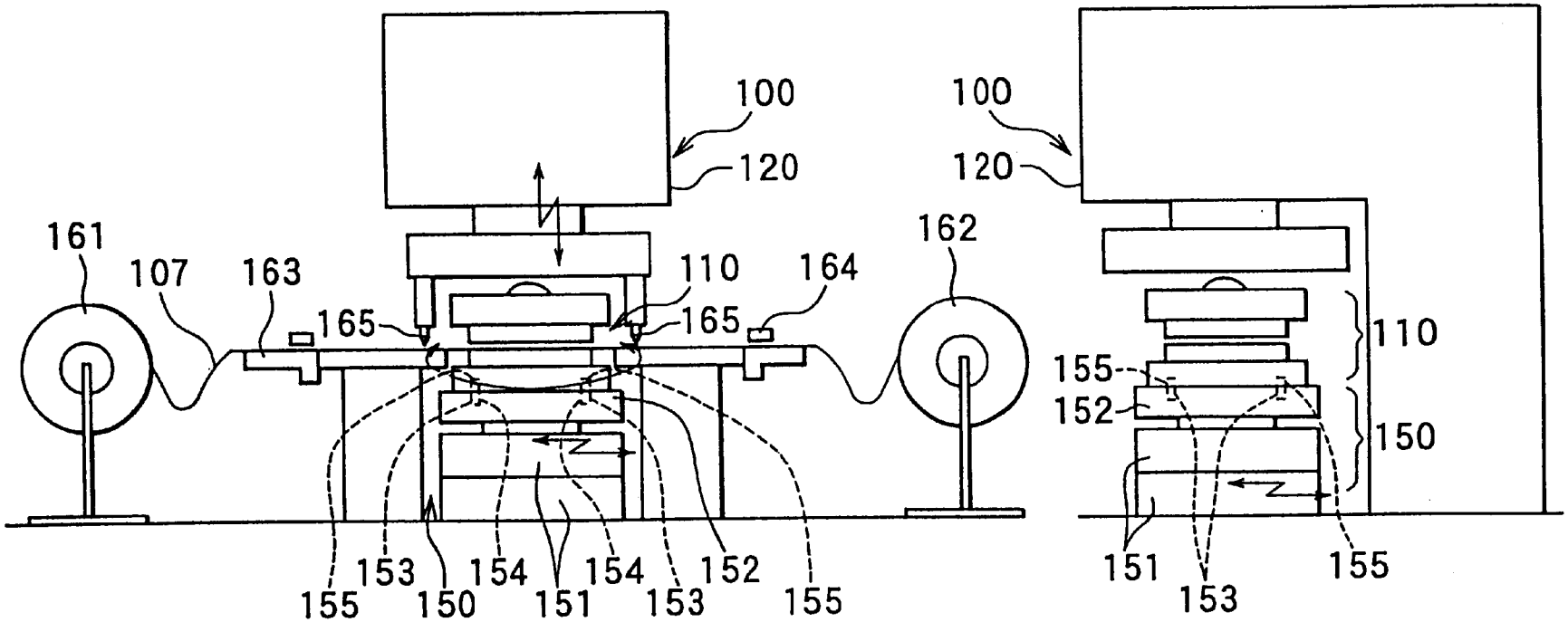
FIG. IB
FIG. IA

METHOD AND APPARATUS FOR MANUFACTURING A PRESS-FORMED OBJECT

CROSS-REFERENCE TO RELATED APPLICATION

The present invention is related to Japanese patent application No. Hei. 11-158422, filed Jun. 4, 1999,

FIELD OF THE INVENTION

This invention relates to a method for manufacturing a press-formed, and more particularly, for manufacturing a press-formed object having a plurality of different holes such as a nozzle hole plate of a fuel injector.

BACKGROUND OF THE INVENTION

To punch an angled hole in a sheet, generally, a die unit must be provided which enables a punch to slide at an angle with respect to the sheet. Such a device is disclosed in Japanese Unexamined Patent Publication No. 207600/1991. A die unit set forth in this publication can be used to make a press-formed object having first and second holes, whose diameters are equal and whose punch directions are symmetrical about a direction normal to the sheet. In this publication, the first hole is first press-formed. Then, the die unit is rotated about a direction normal to the sheet, and the second hole is press-formed.

However, when the die unit is rotated (moved) to form the second hole, the position of the die with respect to the sheet (the workpiece) shifts. It is therefore necessary to adjust the position of the die unit with respect to the sheet (this adjustment is hereinafter referred to as a positioning operation). This operation is carried out after the die unit is rotated (moved).

Consequently, when a die unit is rotated every time one hole is punched for manufacturing press-formed objects, at least one positioning operation occurs during the manufacture of each press-formed object. This increases manufacturing man-hours (manufacturing time). As a result, productivity is lowered, thus making it difficult to achieve manufacturing cost reductions. This especially impacts large volume manufacturing. The present invention was developed in light of these drawbacks.

SUMMARY OF THE INVENTION

It is therefore an object of the present invention to improve the productivity of manufacturing a press-formed object having a plurality of holes.

To achieve this and other objects, a first and second aspect of the present invention provides a first step of press forming a plurality of first holes in a sheet while feeding the sheet in a first direction through a press. In a second step, a second plurality of holes are formed in the sheet while feeding the sheet in a second direction. A third step is provided which cuts the sheet to predetermined dimensions.

In another aspect of the present invention, a press apparatus comprising a feed mechanism capable of switching between a first feeding state and a second feeding state is provided. In the first feeding state, the press apparatus feeds a sheet one way. In the second feeding state, the press apparatus feeds the sheet in the opposite direction. A die unit is provided having a punch and a die for punching first and second holes in the sheet. A table unit is provided which is capable of supporting and moving the die unit with respect to the sheet. As a result, productivity is increased according to that described above.

Further areas of applicability of the present invention will become apparent from the detailed description provided hereinafter. It should be understood that the detailed description and specific examples, while indicating preferred embodiments of the invention, are intended for purposes of illustration only, since various changes and modifications within the spirit and scope of the invention will become apparent to those skilled in the art from this detailed description.

BRIEF DESCRIPTION OF THE DRAWINGS

The present invention will become more fully understood from the detailed description and the accompanying drawings, wherein:

FIG. 1A is a front schematic view of a press apparatus according to the present invention:

FIG. 1B is a side schematic view of a press apparatus according to the present invention;

DETAILED DESCRIPTION OF THE PREFERRED EMBODIMENTS

Figure 2A:
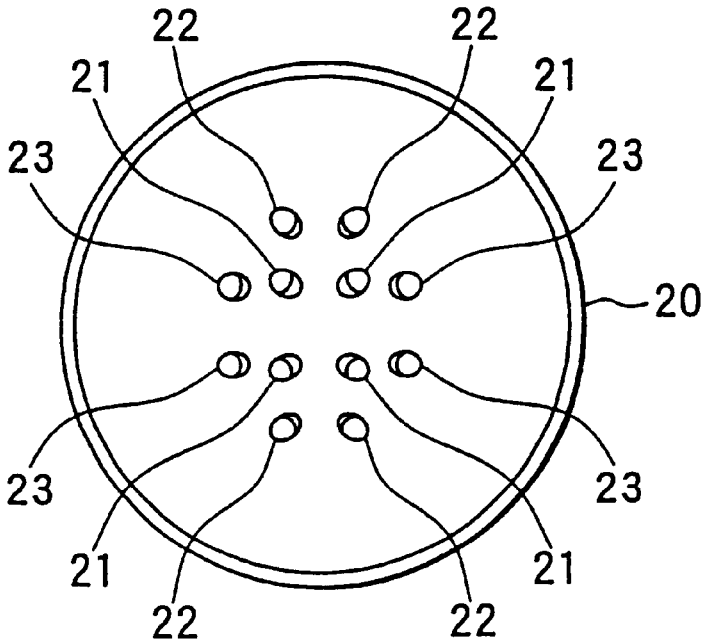
FIG. 2A is a top view of a nozzle hole plate for manufacturing by a press apparatus according to the present invention.

In a first embodiment, as shown in FIGS. 1A, 1B, and 2A, a press 100 is used to form first, second and third nozzle holes 21, 22 and 23 respectively (punched holes). These holes are formed in the base part of nozzle hole plate 20 (a press-formed object) for a fuel injecting device (injector).

Figure 2B:
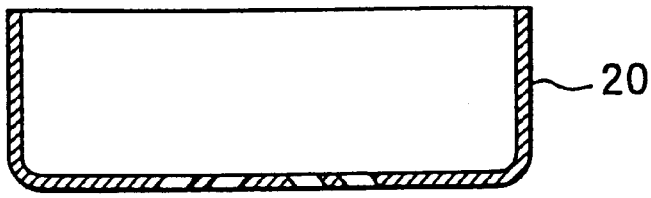
FIG. 2B a side view of a nozzle hole plate for manufacturing by a press apparatus according to the present invention.

Moreover, holes 21, 22 and 23 are different sizes and punch angles with respect to nozzle hole plate 20. The nozzle hole plate 20, as shown in FIGS. 2A and 2B, is approximately cup shaped.

Figure 3:
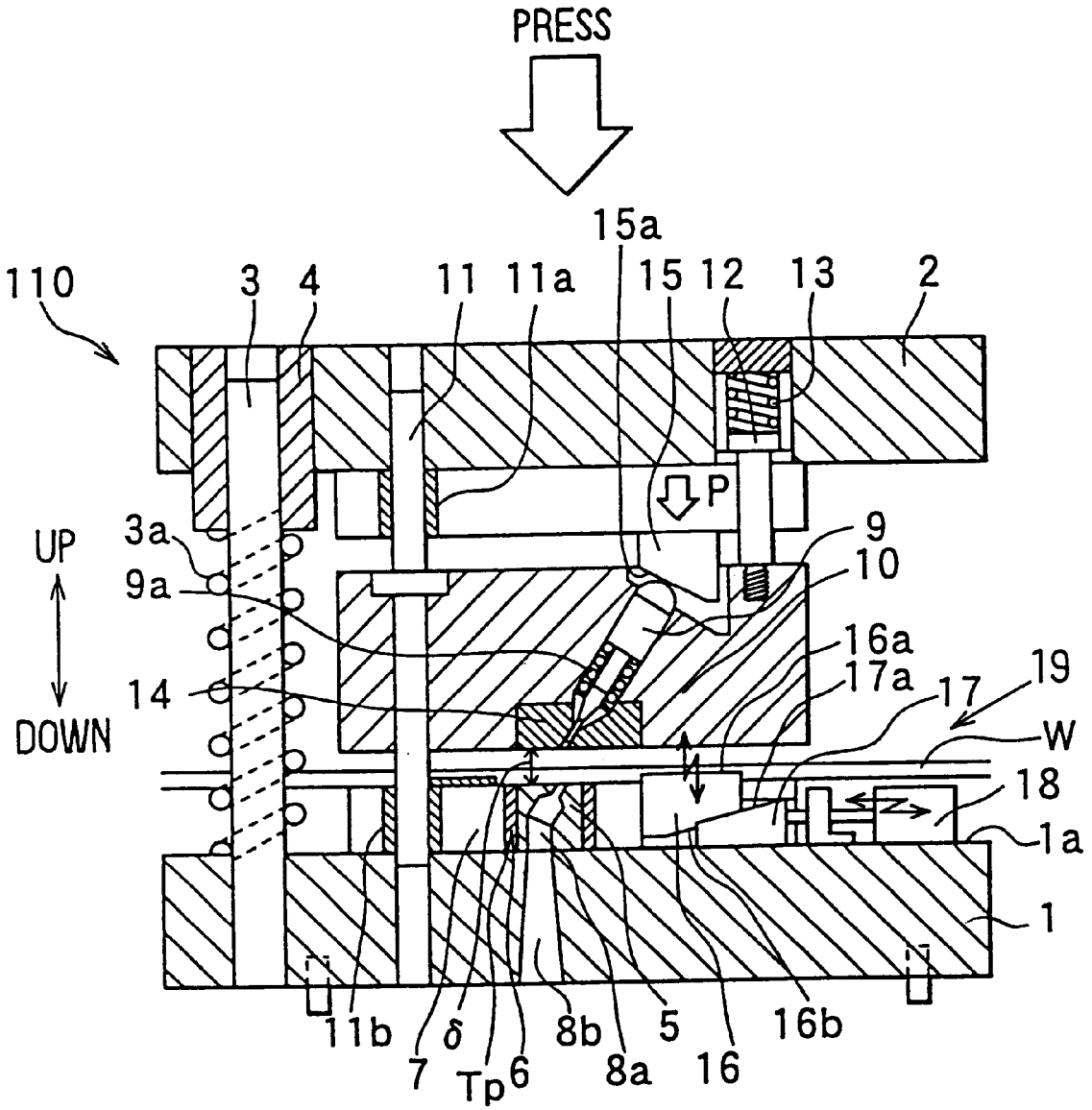
FIG. 3 is a cross-sectional view of a first die unit of a press apparatus according to the present invention.

In FIG. 1A and 1B, press 100 has a press die set 110 for punching nozzle holes 21, 22 and 23 in a thin sheet workpiece w. First die unit 110 is engaged with press machine 120, which is a hydraulic or mechanical press for locomoting upper die base 2 up and down. Die set 110 has a lower die base 1 which is fixed, as shown in FIG. 3, and an upper die base 2 which moves up and down by operation of press machine 120. A first guide post 3 (first guide member) guides the movement of the upper die base 2. A first guide bush 4 is in sliding engagement with the circumferential periphery of the first guide post 3. Guide bush 4 is disposed between the first guide post 3 and the upper die base 2 to allow sliding movement of upper die base 2 and guide post 3. A coil spring 3*a* (elastic member) urges the upper die base 2 and a punch holder 10, which will be further discussed later, in an upward direction.

Press die set 110 contains a lower die 5 (piercing die or female die) and is mounted on the lower die base 1. Lower die 5 is inserted, with a spacer 6 disposed around it, into a hole in a die plate 7. Discharge holes 8*a* and 8*b* allow punch cuttings to discharge and are provided in the die 5 and the lower die base 1, respectively. Punch 9 is positioned in punch holder 10. Punch 9 is slidably received in punch holder 10, which is mounted with a predetermined gap δ between itself and the die 5.

Punch holder 10 is guided by second guide post 11, which extends parallel with the first guide post 3. Punch holder 10 moves up and down with the upper die base 2, and slidably holds punch 9 at an angle to the direction of movement of punch holder 10 (the up/down direction). A coil spring 9*a* urges the punch 9 toward upper die base 2.

The second guide post 11 is press-fitted to the punch holder 10, and a guide bush 11*a* is slidably disposed between the second guide post 11 and the upper die base 2. As a result, the punch holder 10 moves with respect to the upper die base 2. A guide bush 11*b* is interposed between the second guide post 11 and the die plate 7, and renders the second guide post 11 slideable with respect to the die plate 7.

The punch holder 10 thus is structurally positioned with respect to the die plate 7 by the second guide post 11. The second guide post 11 thereby functions as die unit positioning means which fixes the position of the punch 9 (first punch) with respect to the die 5 (first die). The punch holder 10 is also suspended from the upper die base 2 by a hanger bolt 12. Hanger bolt 12 is slidably inserted in the upper die base 2. The hanger bolt 12 is urged toward the die 5 (and the lower die base 1) by a coil spring (elastic member) 13.

Punch holder insert 14 slidingly guides punch 9. Punch holder insert 14 is made of a material (in this preferred embodiment, cemented carbide) harder than the material of the punch holder 10 (in this preferred embodiment, an alloy tool steel such as SKD11).

A pushing member 15 moves integrally with the upper die base 2 and pushes the punch 9 toward the die 5 when upper die base 2 descends. A contact face 15*a* is provided on pushing member 15 where it contacts punch 9. This contact face is inclined to an angle substantially perpendicular to the sliding direction of the punch 9. The portion of the punch 9 which contacts contact face 15*a* is formed with a spherical surface.

A first block 16 makes contact with the punch holder 10 and mechanically regulates a minimum dimension of the gap δ when the punch holder 10 has descended to its lowest point. This minimum gap occurs when the punch holder 10 and the die 5 are closest together, and when face 16*a* contacts punch holder 10. Opposite face 16*a* is first sloping face 16*b* which slopes with respect to the direction of movement of the pushing member 15 (the vertical direction). A second block 17 is disposed slidably on a bed face 1 of the lower die base 1, and a second sloping face 17*a* which is slidable with respect to the first sloping face 16*b* is formed on this second block 17.

Figure 4A:
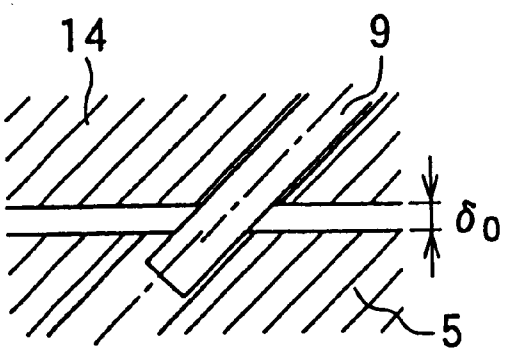
FIGS. 4A is a cross-sectional view of a punch die and part for a press apparatus during a stamping operation according to the present invention.
Figure 4B:
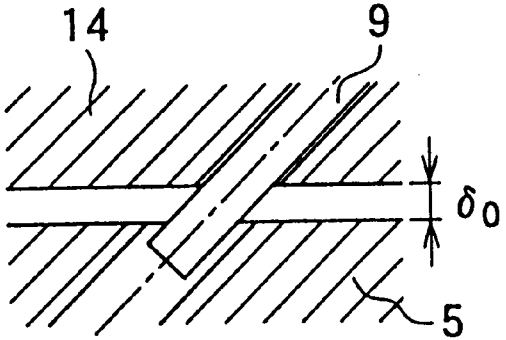
FIGS. 4B is a cross-sectional view of a punch die and part for a press apparatus during a stamping operation according to the present invention.
Figure 4C:
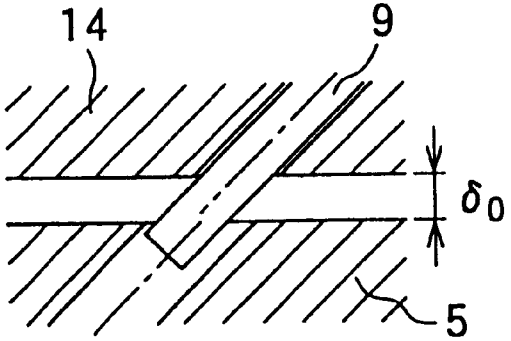
FIGS. 4C is a cross-sectional view of a punch die and part for a press apparatus during a stamping operation according to the present invention.

An actuator (moving means) 18 moves the second block 17 in a direction (a direction parallel with the bed face 1*a*) substantially perpendicular to the direction of movement of the pushing member 15. Actuator 18 and the two blocks 16, 17 make up a dimension adjusting mechanism 19 for adjusting the dimension $\delta_0$ (see FIGS. 4A through 4C) of the gap δ in a direction parallel with the direction of movement of the pushing member 15 (the vertical direction).

Figure 5:
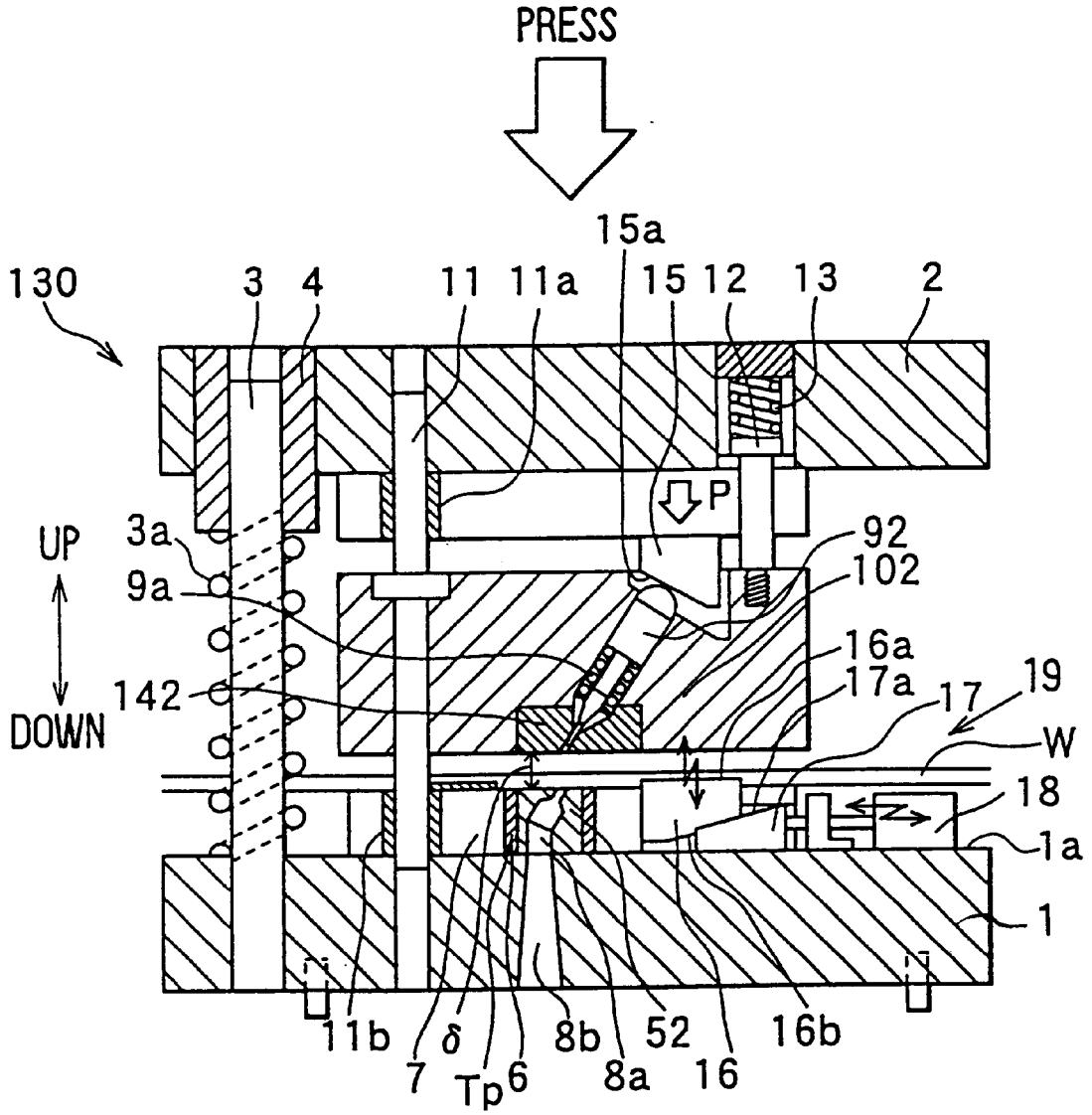
FIG. 5 is a cross-sectional view of a second die unit for a press apparatus according to the present invention.
Figure 6:
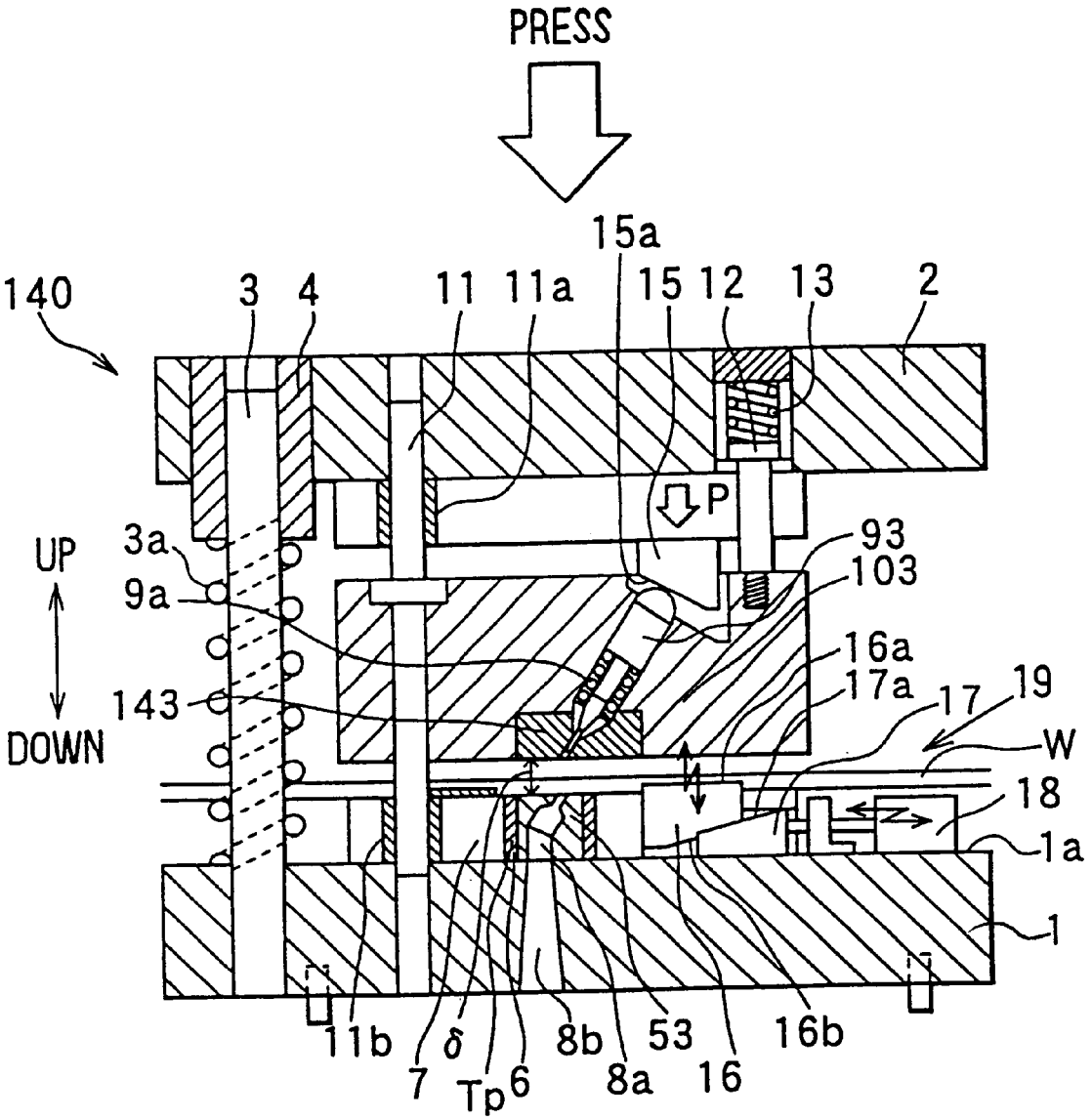
FIG. 6 is a cross-sectional view of a third die unit for a press apparatus according to the present invention.

FIG. 5 shows a second die unit 130 for forming the second nozzle hole 22, and FIG. 6 shows a third die unit 140 for forming the third nozzle hole 23. The second die unit 130 and third die unit 140 provide different sized dies and punches than disclosed in the first die unit 110. Therefore, their reference numerals for these elements have been changed as shown in FIGS. 5 and 6. However, the interrelationship between these components remains the same. A description of such interrelationship therefore has been omitted. Additionally, the punches of the second and third die units move in different directions relative to workpiece w than disclosed in the first die unit to change the entrance angle of the respective hole. The remaining elements are the same as the first die unit. Therefore, a detailed description of these similar elements is also omitted.

In FIG. 1, a support table unit 150 removably supports die units 110. This support table unit 150 is made up of an X-Y table mechanism 151 for moving the die unit in a horizontal plane and a θ table mechanism 152 for rotating the die unit about a vertical axis, parallel with the direction of movement of the pushing member 15. The table mechanisms 151, 152 are ordinary table mechanisms driven by driving means such as servomotors.

Locating pins 153 fix the position of the die unit with respect to the support table unit 150. Insertion holes (die unit positioning means) 154, 155 into which the locating pins 153 are inserted (press-fitted) are formed in the support table unit 150 and the lower die base 1 (of the die unit).

Coil stands 161, 162 support the band-like workpiece w wound in a coil. Feed devices 163, 164 feed the workpiece w through the press 100. Feed devices 163, 164 can switch between a first feeding state in which they feed the workpiece w in one direction, and a second feeding state in which they feed the work piece in the other direction. Hereinafter, a band (workpiece) wound in a coil will be called a roll.

locating pins 165 move up and down integrally with the press machine 120 to fix the position of the workpiece w with respect to the support table unit 150.

The operation of the present invention will now be described.

Figure 8A:
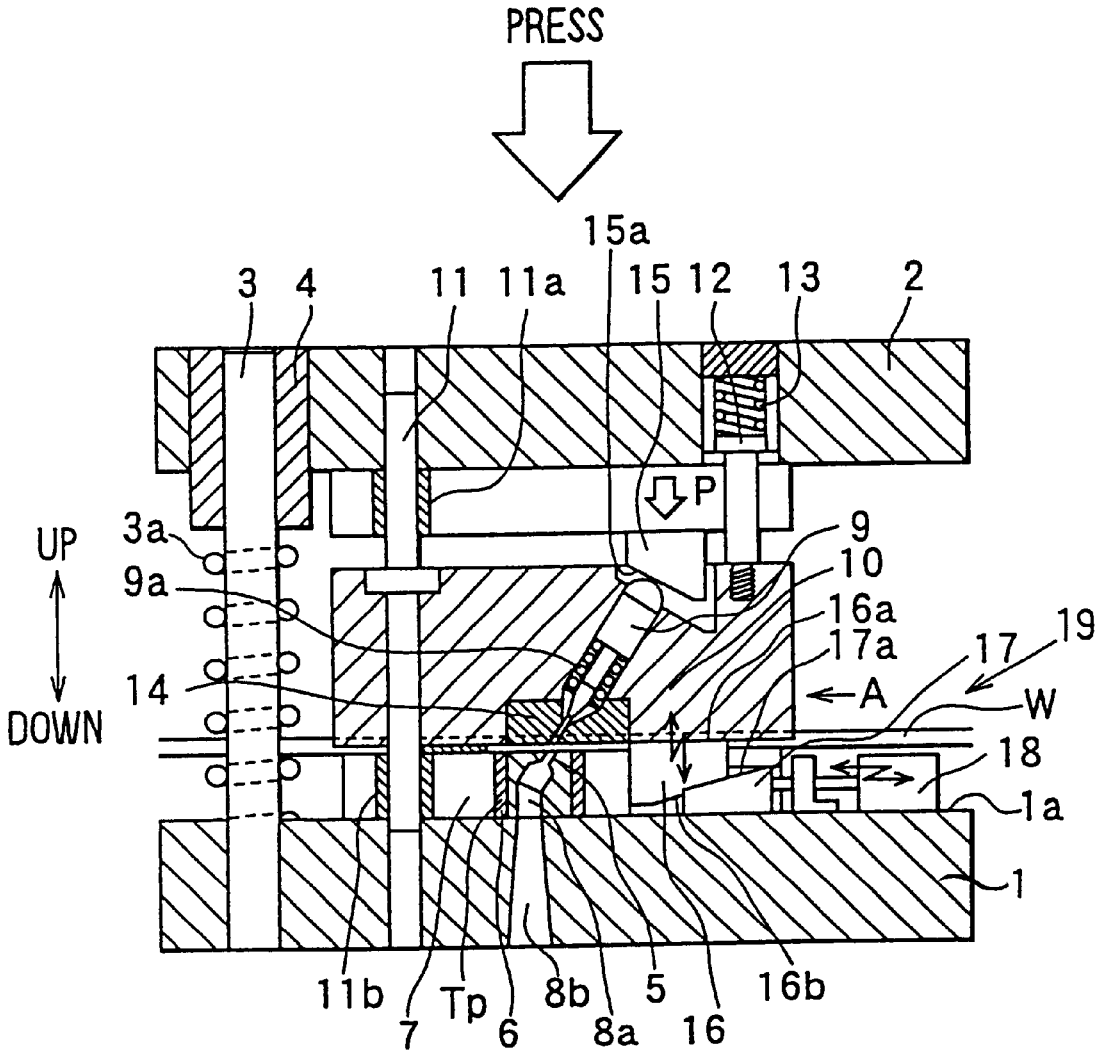
FIG. 8A is a cross-sectional view of a press apparatus showing a punch holder according to the present invention FIG. 8B a view in the direction of the arrow A of FIG. 8A of a press according to the present invention.

In FIG. 3, when the upper die base 2 is pushed by the press machine 120, the upper die base 2 moves toward the lower die base 1. At this time, because the punch holder 10 is suspended from the upper die base 2, it moves toward the die 5 while remaining a fixed distance from the upper die base 2. This continues until it makes contact with the first block 16, as shown in FIG. 8A.

Figure 9:
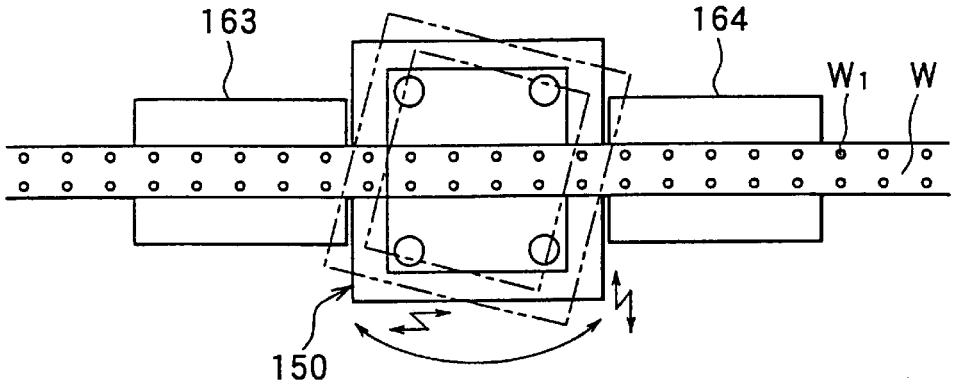
FIG. 9 is a top view of the press apparatus of a first preferred embodiment according to the present invention.

Locating holes w1 are provided in the workpiece w with a uniform inter-spacing, in its length wise direction, as shown in FIG. 9. When the upper die base 2 and the locating pins 165 move toward the lower side (the lower die base 1 side), the locating pins 165 are inserted into the locating holes w1, thereby affixing the workpiece w in position with respect to the support table unit 150.

After contacting block 16, movement of the punch holder 10 is regulated by the first block 16. Therefore, only the pushing member 15 moves downward integrally with the upper die base 2. As such, the punch 9 is pushed by the pushing member 15 and moves toward the die 5. Consequently, the workpiece w is pushed by the punch 9, and a first nozzle hole 21 is formed in the workpiece w. Moreover, the first nozzle hole 21 is formed while the work piece w is in a fixed position with respect to the support table unit 150.

The above described series of operations is the same for formation of the second and third nozzle holes 22 and 23, as well as for the first nozzle hole 21. This series of operations is hereinafter referred to as the piercing step.

Next, a method for manufacturing a press-formed object is described having the following steps.

1. In the first piercing step, the First Nozzle Hole 21 is formed. Here, the first die unit 110 is first fixed in position on the support table unit 150. Then, while the workpiece w is fed one way in its length wise direction (towards the right side of FIG. 1A), a piercing step, as described above, is continuously carried out until there is no workpiece w left wound on the coil stand 161 (first step).

Then, the support table unit 150 (the θ table mechanism 152) is moved (rotated about a direction normal to the workpiece w) as shown in FIG. 9 to change the angle of the punch 9, with respect to the workpiece w. Then, while the workpiece w is fed in the opposite direction to that of the first step (toward the left side of FIG. 1A), a piercing step is continuously carried out until no workpiece w remains wound on the coil stand 162.

2. In a second piercing step, the Second Nozzle Hole 22 is formed. Here, the first die unit 110 is first removed from the support table unit 150, and the second die unit 130 is fixed in position on the support table unit 150. Then, in the same way as described above in forming the First Nozzle Hole 21, a piercing step is continuously carried out until there is no more workpiece w left wound on the coil stand 161. This piercing step is carried out while the workpiece w is fed into the press one way, in its length-wise direction.

Then, the support table unit 150 (the θ table mechanism 152) is rotated, thereby changing the angle of the punch 9 relative to the workpiece w. While the workpiece w is fed in the opposite direction to that of the first step, a piercing step is continuously carried out until no more workpiece w remains wound on the coil stand 162.

3. In the third piercing step, the Third Nozzle Hole 23 is formed. Here, the second die unit 130 is first removed from the support table unit 150, and the third die unit 140 is fixed in position on the support table unit 150. Then, the third nozzle hole is formed in the same way as the first Nozzle Hole 21 as described above, while the workpiece w is fed one way in its length wise direction. Thus, a piercing step is continuously carried out until no more workpiece w remains wound on the coil stand 161.

Then, the support table unit 150 is again rotated to change the angle of punch 9 relative to workpiece w. Then, while the workpiece w is fed in the opposite direction to that of the first step, a piercing step is continuously carried out until no workpiece w remains wound on the coil stand 162.

4. In a nozzle hole plate forming step (Third step), After the first through third piercing steps are complete, the workpiece w on coil stand 161 is fitted to the coil stand 171. The workpiece w on coil stand 171 is then fed through the forming press 170. Here, circular portions of the workpiece w where the first through third nozzle holes 21 through 22 are formed are punched out with predetermined dimension as shown in FIG. 7B. Simultaneously, the punched-out circular workpiece w is formed approximately cup shaped.

Figure 7A:
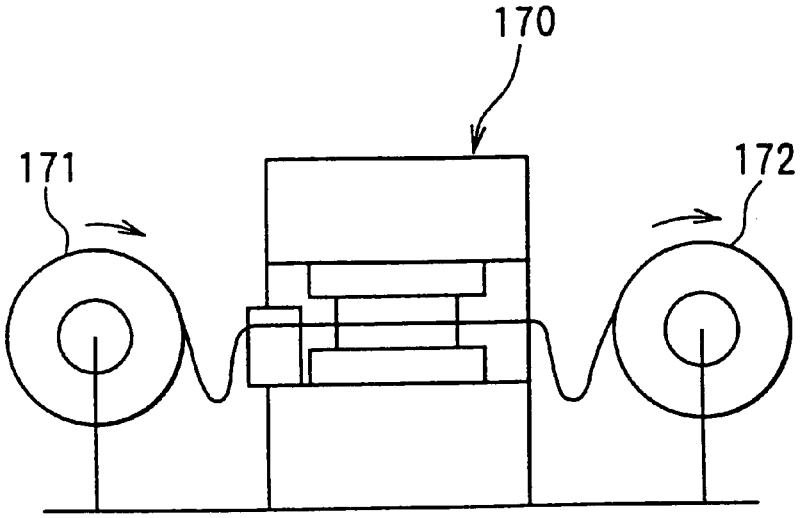
FIG. 7A is a schematic view of a forming press apparatus according to the present invention.
Figure 7B:
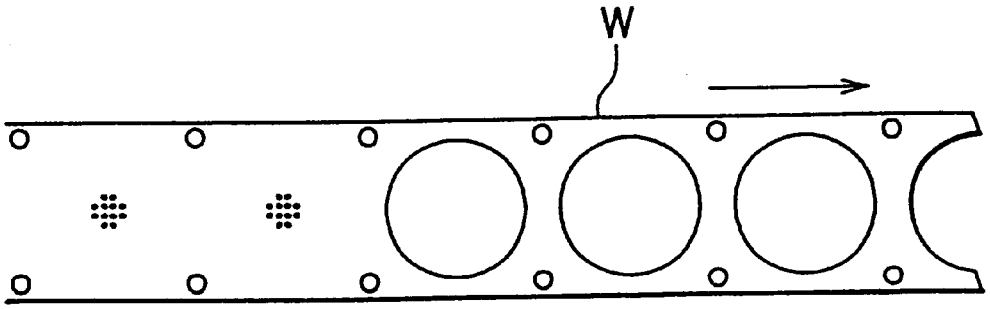
FIG. 7B is a top view of a work piece in a forming press apparatus according to the present invention.

FIG. 7A is a schematic view of the forming press 170 used in the nozzle hole plate-forming step. Forming press 170 punches out portions of workpiece w as described above and as shown in FIG. 7B. Simultaneously, this device forms the punched-out circular workpiece w as approximately cupped shape (see FIG. 2). Workpiece w is shown wound on coil stand 171 after having completed first through third piercing steps. Coil stand 172 takes up residual material (scrap material) remaining after the workpiece w is cut out. Feed devices (not shown) of the forming press 170 feed the workpiece w in one direction only.

The dimension adjusting mechanism 19 will now be described. The dimension adjusting mechanism compensates for when workpiece w has changed, or when the punch 9 or the die 5 has worn out, requiring punch 9 to be adjusted with respect to die 5. The relative positions of the punch 9 and the die 5 are adjusted by changing the dimension $\delta_0$ as mentioned above (adjusting step).

Then, after the adjusting step is finished, the press machine 120 is operated and, as described above, the punch 9 is pushed toward the die 5 by the pushing member 15, and a nozzle hole is formed (pressing step) in the workpiece w (metal sheet). In this example, adjustment is provided before pressing only when the thickness of the workpiece w has changed or when the punch 9 or the die 5 has worn out. This creates a need to adjust the punch 9 with respect to the die 5. Alternatively, however, to further improve product quality, an adjusting step can be provided before the pressing step, every time the press apparatus is operated.

Some notable characteristics of the present invention will now be discussed. As mentioned above, when the die units 110, 130 and 140 are rotated or otherwise moved with respect to the workpiece w, a positioning operation is necessary. In the related art, as previously discussed, because the die unit must be rotated each time a hole is press-formed, it is necessary for a positioning operation to be carried out 12×n times. (Twelve being the total number of the first through third nozzle holes 21 through 23.)

With the present invention, however, n nozzle holes of equal punch angle and size are formed continuously while the workpiece w is fed one way. Then, the feed direction is reversed and the die unit is rotated and further n nozzle holes are formed continuously. To form n nozzle hole plates 20, it is only necessary for a positioning operation to be carried out twelve times.

As a result of the above, because a large number of first holes are first formed, followed by formation of the second holes, the positioning operation must be carried out only twice, even when a large number of press-formed objects are to be formed from one band-like sheet.

In the present invention, the positioning work time is cut to 1/n compared to a related art manufacturing method (wherein n is the number of press formed objects). As such, as the number of press-formed objects manufactured from a single sheet increases, manufacturing man-hours decreases. Accordingly, the productivity of manufacturing press-formed objects is improved.

Because work time to be cut to 1/n compared to the related art, production loss is reduced as the number of product increases. Also, because in each of the die units 110, 130 and 140; the punches 9, 92 and 93; and the dies 5, 52 and 53 of the die units 110, 130 and 140; are incorporated into one unit and fixed in position relative to each other by the second guide post 11, the different sized nozzle holes 21, 22 and 23 can be punched easily. The die units need only be fitted to the support table unit 150, without requiring alignment of the punches 9, 92 and 93 with the dies 5, 52 and 53.

Also, because of this fixturing, the holemaking accuracy is improved. Also, punch 9 is held in the punch holder 10 such that it can slide at an angle with respect to the direction of movement of pushing member 15. Thus, if the dimension $\delta_0$ is adjusted by operation of the dimension adjusting mechanism 19, the punch 9 moves in a direction perpendicular to the direction to the dimension $\delta_0$ (the pushing direction of the pushing member 15). Therefore, the punch 9 can be aligned to the die 5, an operation carried out easily with the dimension adjusting mechanism 19.

Figure 8B:
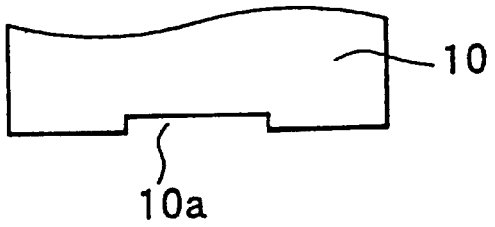

Therefore, because it is not necessary for the position of the punch to be adjusted by combining different thickness plates, positional adjustment of the punch 9 and die 5 can be carried out simply and accurately, irrespective of the skill of the operator doing the adjustment. Because positional adjustment of punch 9 and die 5 is carried out by adjusting the dimension $\delta_0$, a concavity (recess part) 10*a* which is slightly larger than the thickness of the workpiece w is formed in the part of the punch holder 10 facing the workpiece w, as shown in FIG. 8B.)

In the present invention, positional adjustment of the punch 9 and the die 5 in the direction (hereinafter, this direction will be called the Y-direction) perpendicular to the sliding direction of the punch 9 is carried out by an adjustment method using thickness plates with the second guide post 11 as a reference.

in press-working, to form a nozzle hole in a nozzle plate of a fuel injector, it is necessary for positional adjustment in the feed direction to be carried out more frequently than positional adjustment in the Y-direction. This is the result of variation in the thickness of the workpiece w and wear of the punch 9. Therefore, with a workpiece w for which it is required that positional adjustment in the Y-direction be carried out as frequently as positional adjustment in the feed direction, it is preferable for the Y-direction positional adjustment to be carried out by the same kind of means as the feed direction positional adjustment.

Figure 10:
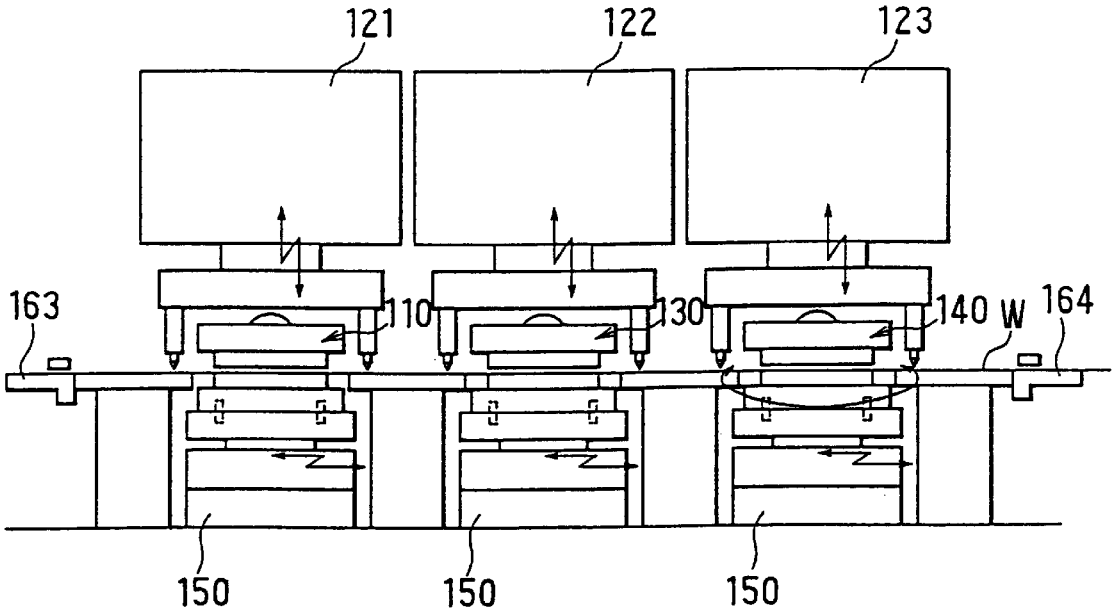
FIG. 10 is a schematic view of a press apparatus according to a second preferred embodiment of the present invention.

FIG. 10 illustrates a second embodiment of the present invention. In this second preferred embodiment a press apparatus is provided with a press machine 121, 122, 123 for each of the die units 110, 130 and 140. This eliminates the need to interchange die units 110, 130 and 140 as described in the previous embodiment. This improves holemaking precision while also increasing the productivity of the manufacture of a nozzle hole plate 20.

While the above-described embodiments refer to examples of usage of the present invention, it is understood that the present invention may be applied to other usage, modifications and variations of the same, and is not limited to the disclosure provided herein.

What is claimed is:

1. A method for manufacturing a plurality of press-formed objects having different sized holes, said method comprising:

feeding a sheet of material along a path through a press in a first direction, said press forming a plurality of first holes in said sheet;

feeding said sheet of material through said press in a second direction, said second direction being along said path but opposite in direction to said first direction, said press forming a plurality of second holes in said sheet, said second holes being at different locations from said first holes;

said first holes are formed at a first acute angle with respect to a plane normal to a horizontal plane of said sheet, said second holes are formed at a second acute angle with respect to a plane normal to a horizontal plane of said sheet and, cutting said sheet to form said plurality of press formed objects, wherein feeding said sheet of material through said press in said first direction is accomplished using a first feeder and feeding said sheet of material through said press in said second direction is accomplished using a second feeder, and wherein during feeding, said press, said first feeder and said second feeder are fixed relative to a floor on which they are situated, and wherein said press comprises a support table unit which supports a first die set said support table unit made up of a rotatable table mechanism for rotating the die set in a horizontal plane parallel to said sheet of material and an angle table mechanism for moving said die unit about a vertical axis perpendicular to said sheet of material;

said method further comprising rotating said die set about said vertical axis after feeding said sheet in said first direction and before feeding said sheet in said second direction.

2. The method as claimed in claim 1 wherein:

said first die set having a punch, said punch having a diameter, said punch forming said first plurality of holes and said second plurality of holes at said first diameter.

3. The method as claimed in claim 2, further comprising the steps of:

removing said first die set after forming said first plurality of holes and said second plurality of holes;

installing a second die set, said second die set having a second punch with a second diameter;

feeding said sheet of material through said press in said first direction, said press forming a plurality of third holes in said sheet with said second punch;

feeding said sheet of material through said press in said second direction, said press forming a plurality of fourth holes in said sheet with said second punch; and cutting said sheet to form said plurality of press formed objects.

4. The method as claimed in claim 1, wherein said press formed object is a nozzle hole plate for a fuel injector.

5. A method for manufacturing a press-formed object having a plurality of first holes and a plurality of second holes, said method comprising the steps of:

continuously press-forming said first plurality of holes in a sheet while feeding the sheet into a press in a first direction, said press forming said first plurality of holes at an acute angle with respect to a plane normal to the horizontal plane of said sheet;

continuously press-forming said second plurality of holes in said sheet while feeding said sheet through said press in an opposite direction to said first direction to form said plurality of second holes in said sheet at an acute angle with respect to a plane normal to the horizontal plane of said sheet, said plurality of second holes being additional holes to said first holes; and cutting said sheet to form a plurality of said press formed objects;

wherein feeding said sheet of material through said press in said first direction is accomplished using a first feeder and feeding said sheet of material through said press in said second direction is accomplished using a second feeder, wherein during feeding, said press, said first feeder and said second feeder are fixed relative to a floor on which they are situated, and wherein said press comprises, a support table unit which supports a die unit, said support table unit made up of a rotatable table mechanism for rotating the die unit in a horizontal plane parallel to said sheet of material and an angle table mechanism for moving said die unit about a vertical axis perpendicular to said sheet of material.

* * * * *